US006193210B1

(12) United States Patent
Katoh

(10) Patent No.: US 6,193,210 B1
(45) Date of Patent: Feb. 27, 2001

(54) FASTENING FITTING WITH A REINFORCING MEMBER-TIGHTENING PORTION

(76) Inventor: Akira Katoh, 674-2 Oaza, Shimokami, Tokuyama-shi Yamaguchi-ken (JP)

( * ) Notice: Subject to any disclaimer, the term of this patent is extended or adjusted under 35 U.S.C. 154(b) by 0 days.

(21) Appl. No.: 09/175,348

(22) Filed: Oct. 20, 1998

(51) Int. Cl.[7] ..... E04G 17/00

(52) U.S. Cl. ..... 249/219.1; 249/4; 249/45; 249/46; 249/192; 249/219.2; 403/213

(58) Field of Search ..... 249/219.1, 219.2, 249/4, 5, 7, 22, 23, 33, 36, 45, 46, 192, 193; 403/213, 209, 206

(56) References Cited

U.S. PATENT DOCUMENTS

| | | | | |
|---|---|---|---|---|
| 614,957 | * | 11/1898 | Journeay | 403/213 X |
| 3,584,827 | * | 6/1971 | Shoemaker | 249/45 |
| 4,194,717 | * | 3/1980 | Easton et al. | 249/192 |
| 4,228,986 | * | 10/1980 | Schimmel et al. | 249/192 X |
| 4,307,837 | * | 12/1981 | Leingang | 238/282 |
| 4,401,291 | * | 8/1983 | Gallis | 249/219.1 X |
| 4,435,102 | * | 3/1984 | Smith | 403/206 |
| 4,480,358 | * | 11/1984 | Barling et al. | 403/209 X |
| 4,993,879 | * | 2/1991 | Hilfiker | 405/209 X |
| 5,522,579 | * | 6/1996 | Rock | 249/219.1 |
| 5,562,845 | * | 10/1996 | Miller et al. | 249/45 |
| 5,584,854 | * | 12/1996 | Minarik | 606/201 |
| 5,802,795 | * | 9/1998 | Myers et al. | 249/45 X |

* cited by examiner

*Primary Examiner*—Eileen D. Lillis
*Assistant Examiner*—Jong-Suk Lee
(74) *Attorney, Agent, or Firm*—Kanesaka & Takeuchi

(57) ABSTRACT

A fastening fitting is formed of a U-shaped fastening portion with a straight portion and a narrow mouth for holding a member therein, a linearly extending portion extending from the straight portion to be bent with respect to a plane including the U-shaped fastening portion with an angle between 80 and 130 degrees, a reinforcing member-tightening portion extending upwardly from an end of the linearly extending portion with an angle between 85 and 110 degrees with respect to the linearly extending portion, and a horizontally protruding portion protruding outwardly from the end of the linearly extending portion substantially parallel to the plane including the U-shaped fastening portion. The linearly extending portion, the reinforcing member-tightening portion and the horizontally protruding portion intersect at one point. The fastening fitting can be used easily together with molding frames and a separator.

6 Claims, 7 Drawing Sheets

FASTENING FITTING WITH A REINFORCING MEMBER-TIGHTENING PORTION

BACKGROUND OF THE INVENTION

1. Field of the Invention

The present invention relates to a fastening fitting with a reinforcing member-tightening portion. More specifically, the invention relates to a fastening fitting with a reinforcing member-tightening portion adapted to be used for concrete-molding frames and the like.

2. Prior Art

A U-shaped fastening fitting (prior art) called U-clip shown in FIG. 6 has heretofore been widely used for the concrete-molding frames made of steel. This fastening fitting is convenient-for firmly supporting and fastening the required portions of the back surfaces of the molding frames, and is made of a rod of low carbon steel or medium carbon steel which is relatively cheaply available.

When a large concrete structure is to be constructed, in many cases, unit frames each having a unit weight of about 10 to 30 kilograms are used to be connected in many portions. In this case, the combined frames as a whole tend to lose the strength. In many cases, therefore, several to several tens of a pair of reinforcing members such as steel pipes are arranged in parallel cross on back surfaces of the frames.

The molding frames made of steel are generally assembled and secured together roughly in two ways depending upon the methods of tightening the molding frames and the reinforcing members. Here, however, the molding frame-fastening fitting and the fastening method are the same.

A first method is a widely employed method of executing the work according to which the surface plate of the molding frame is not perforated, and a plate-like separator is sandwiched by two pieces of molding frames by utilizing holes A perforated in the molding frames and is secured by the fittings penetrating therethrough. In this case, the reinforcing members are tightened by inserting a tightening fitting in a hole B separately perforated near the hole A in the frames. This method, however, has a demerit in that the reinforcing members are not tightened on a coaxial extension of the separator due to its structure.

According to a second method, holes C are formed in the surface plates of the molding frames, the ends of a rod-like separator are inserted in the holes C, C of the two surface plates, rod-like metallic fastening fittings are screwed into the threaded ends of the separator from the outer sides of the surface plates, thereby to fasten the reinforcing members. This method has a merit in that the reinforcing members can be tightened on a coaxial extension of the separator. However, since holes are formed in the surface plates, undesired ruggedness is formed after the concrete has been solidified, impairing smoothness on the finished surface and shortening the life (number of times of repetitive use) of the steel molding frames.

Besides, the conventional fastening fitting for steel molding frames requires a separate fitting for tightening the reinforcing members, involving difficulty in tightening to the reinforcing members. In particular, in high places and in narrow places where the scaffolding is not safe enough, three kinds of parts must be used, i.e., U-shaped fastening fitting, straight rod-like tightening fitting and tightening washer for securing the reinforcing members to the steel molding frames by using a separate tightening fitting, requiring laborious work for correctly positioning these parts and causing the work to become very difficult.

Besides, when a conventional fitting (metal tie) of the twisted type 201 (see FIG. 7) for tightening the reinforcing materials is inserted in the through holes of the frames 40, 40 that are vertically erected as shown in FIG. 8, one side which is longer tends to be lowered due to gravity, hindering the work.

SUMMARY OF THE INVENTION

The present inventors have discovered the fact that the above-mentioned problems can be solved at one time by adding a reinforcing member-tightening portion to a portion of the conventional fastening fitting as a unitary structure, and have arrived at the present invention through contrivance and trial.

That is, the present inventors have added a reinforcing member-tightening portion to the fastening fitting relying basically upon the first method, so that the reinforcing members can be tightened on an extension of the separator.

The object of the present invention is to provide a fastening fitting with a reinforcing member-tightening portion formed as a unitary structure, that contributes to improving working efficiency on a dangerous and narrow working site, yet offering increased strength for the combined molding frames.

Another object of the present invention is to provide a fastening fitting with a reinforcing member-tightening portion which is easy to handle having a decreased number of parts compared with that of the prior art.

In order to accomplish the above-mentioned objects, the present invention provides a fastening fitting with a reinforcing member-tightening portion comprising:

- a U-shaped fastening portion 5 with a narrow mouth;
- a linearly extending portion 11 that is extending nearly horizontally from the U-shaped engaging portion 5 with a narrow mouth being bent by an angle $\alpha$ of 80 to 130 degrees from a plane 6 inclusive of a U-shaped plane 5A;
- a reinforcing member-tightening portion 15 which rises from the linearly extending portion 11 at an angle $\beta$ of 85 to 110 degrees; and
- a horizontally protruding portion 20 that protrudes nearly in parallel with the U-shaped plane 5A from the root of said reinforcing member-tightening portion 15 (first aspect).

The invention further provides a fastening fitting with a reinforcing member-tightening portion of first aspect, wherein an end 15A of said reinforcing member-tightening portion 15 is in the form of a threaded bolt (second aspect).

The invention further provides a fastening fitting with a reinforcing member-tightening portion of first aspect, wherein an end 15B of said reinforcing member-tightening portion 15 has elongated holes 17 for inserting a wedge (third aspect).

The invention provides a fastening fitting with a reinforcing member-tightening portion of the first aspect, which is used in combination with a separator having plate-like ends on both sides thereof, wherein in a junction portion of a pair of molding frames that are crossing, and engaging with, said separator at an angle of 0 to 50 degrees relative to the lengthwise direction thereof, the plate-like ends of said separator are held between said molding frames, said horizontally protruding portion 20 is inserted in the holes formed in the one frame, in the plate-like end and in the other frame so as to be turned about the axis thereof, and the frames are fastened together by the U-shaped fastening portion 5 (fourth aspect).

The invention further provides a fastening fitting with a reinforcing member-tightening portion of the fourth aspect, wherein said separator is of the form of a straight rod, a flat plate or has a U-shape in cross section (fifth aspect).

DESCRIPTION OF THE PREFERRED EMBODIMENTS

Figure 1:
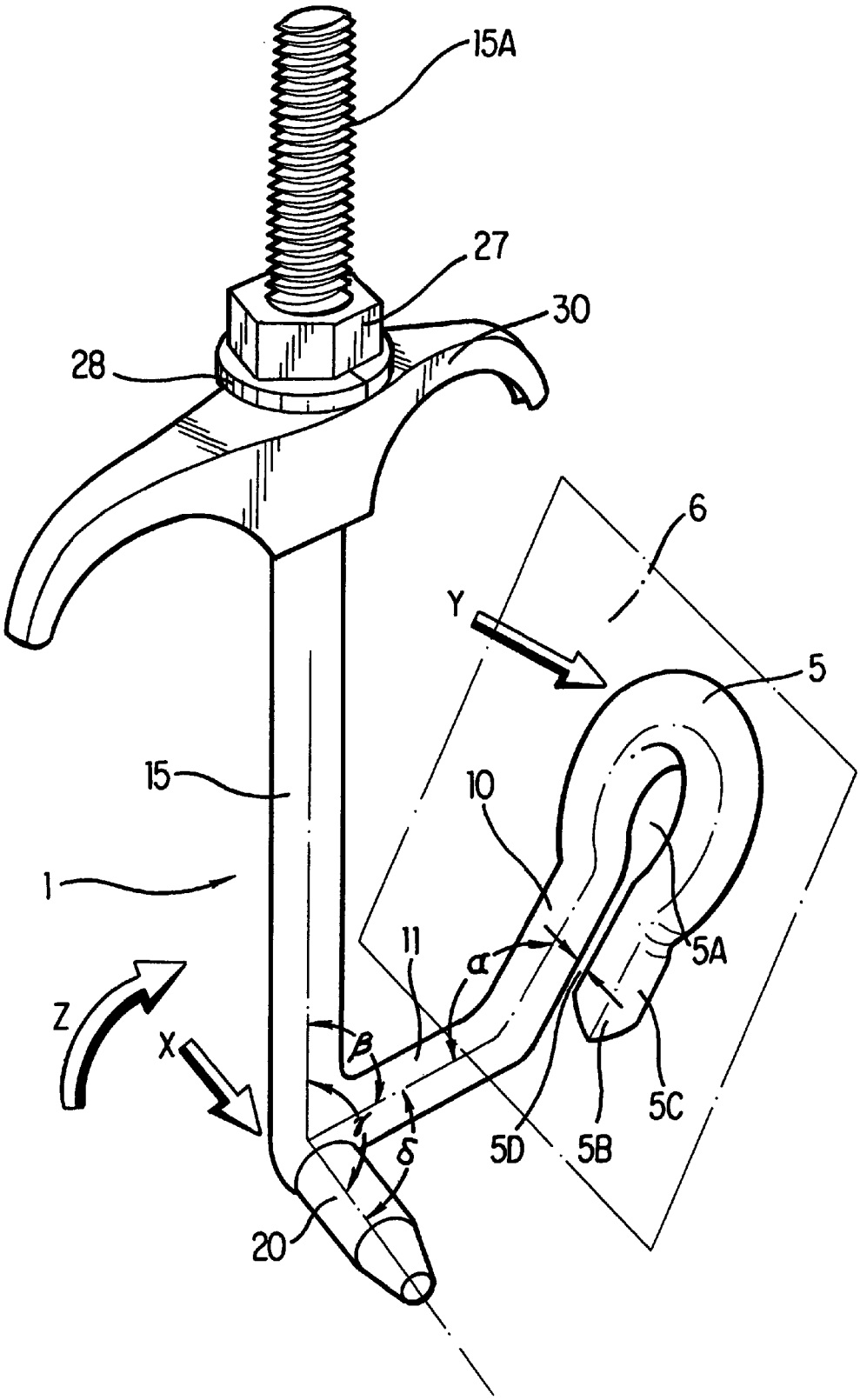
FIG. 1 is a perspective view of a fastening fitting with a reinforcing member-tightening portion according to an embodiment of the present invention.

The invention will now be described in detail by way of embodiments.

In FIGS. 1, 2, 3, 4 and 5, reference numeral 1 denotes a fastening fitting with a reinforcing member-tightening portion according to an embodiment of the present invention, 5 denotes a U-shaped fastening portion with a narrow mouth, 6 denotes a U-shaped plane, 10 denotes a straight portion, 11 denotes a linearly extending portion, $\alpha$ denotes an angle subtended by the U-shaped plane 6 and the extending portion 11, reference numeral 15 denotes a portion for tightening the reinforcing members, 15A denotes a threaded portion, 15B denotes an end, 17 denotes elongated holes, 18 denotes a wedge, 20 denotes a horizontally protruding portion, 27 denotes a nut, 28 denotes a spring washer, 30 denotes an arm-like metal fitting, 40 denotes frames, 50 denotes a separator, 50A denotes an end of the separator, 40B and 50B denote through holes in the ends of the frame and the separator, 60A and 60B denote surface plates, 70 and 71 denote pipes (reinforcing members), 100 denotes a concrete, and reference numeral 200 denotes a U-clip of a prior art.

In FIG. 1, the reinforcing member-tightening portion 15 is of a cylindrical form with its upper part being threaded (which may also be hot-press worked), and is continuous at its root to the horizontally protruding portion 20 and to the linearly extending portion 11 at angles $\beta$ and $\gamma$, respectively. The U-shaped fastening portion 5 with a narrow mouth is rising from the linearly extending portion 11 at a rising angle $\alpha$ ($80° \leqq \alpha \leqq 130°$)($\gamma$ and $\delta$ are nearly 90 degrees) and is continuous thereto. The U-shaped fastening portion 5 with a narrow mouth has a center axis on a plane 6 that includes the U-shaped plane 5A which includes the center line of the central portion of the U-shaped fastening portion 5, and the rising angle $\alpha$ is the one subtended by the plane 6 and the linearly extending portion 11 on a plane that includes the center line of the reinforcing member-tightening portion 15 that intersects the plane 6 at right angles. It is desired that the angle $\beta$ subtended by the reinforcing member-tightening portion 15 and the linearly extending portion 11 is $85° \leqq \beta \leqq 110°$. This is because, when the angle $\beta$ is smaller than 85 degrees, the reinforcing member-tightening portion 15 is excessively inclined when the U-shaped fastening portion 5 with a small mouth is fully utilized. When the angle $\alpha$ exceeds 110 degrees, on the other hand, the reinforcing member-tightening portion 15 is excessively inclined unless the angle $\alpha$ is decreased or the depth of the U-shaped fastening portion 5 with a narrow mouth is increased, which is not practicable. The range of the angle $\beta$ is determined chiefly from the standpoint of workability.

It is important that the U-shaped plane 5A is nearly in parallel with the horizontally protruding portion 20 from the standpoint of holding a pair of frames 40, 40 as will be described later.

When the rising angle $\alpha$ is smaller than 80 degrees, it becomes difficult to hold the pair of frames 40, 40. When the angle $\alpha$ exceeds 130 degrees, on the other hand, the depth for holding decreases, and the pair of frames are not held to a sufficient degree. It is therefore desired that the angle $\alpha$ lies within a range of $80 \leqq \alpha \leqq 130°$.

The straight portions 10 and 5C of the U-shaped fastening portion 5 with a narrow mouth are nearly in parallel with each other, and a gap 5D thereof is slightly smaller than the sum of thicknesses of the pair of frames 40, 40 and the end 50A of the separator. Therefore, the gap 5D is expanded due to resilient deformation when three pieces of plates (frame 40, end 50A of the separator, frame 40) are inserted therein. In this case, the three pieces of plates (hereinafter referred to as superposed plates) are pressurized in the direction of thickness. Being assisted by the tensile stress of the reinforcing member-tightening portion 15 based on the nut 27 and spring washer 28, therefore, the three members, i.e., the frame, separator and reinforcing member, are firmly secured together without gap (see FIGS. 1 and 2).

This is done through a process described below.

Figure 2:
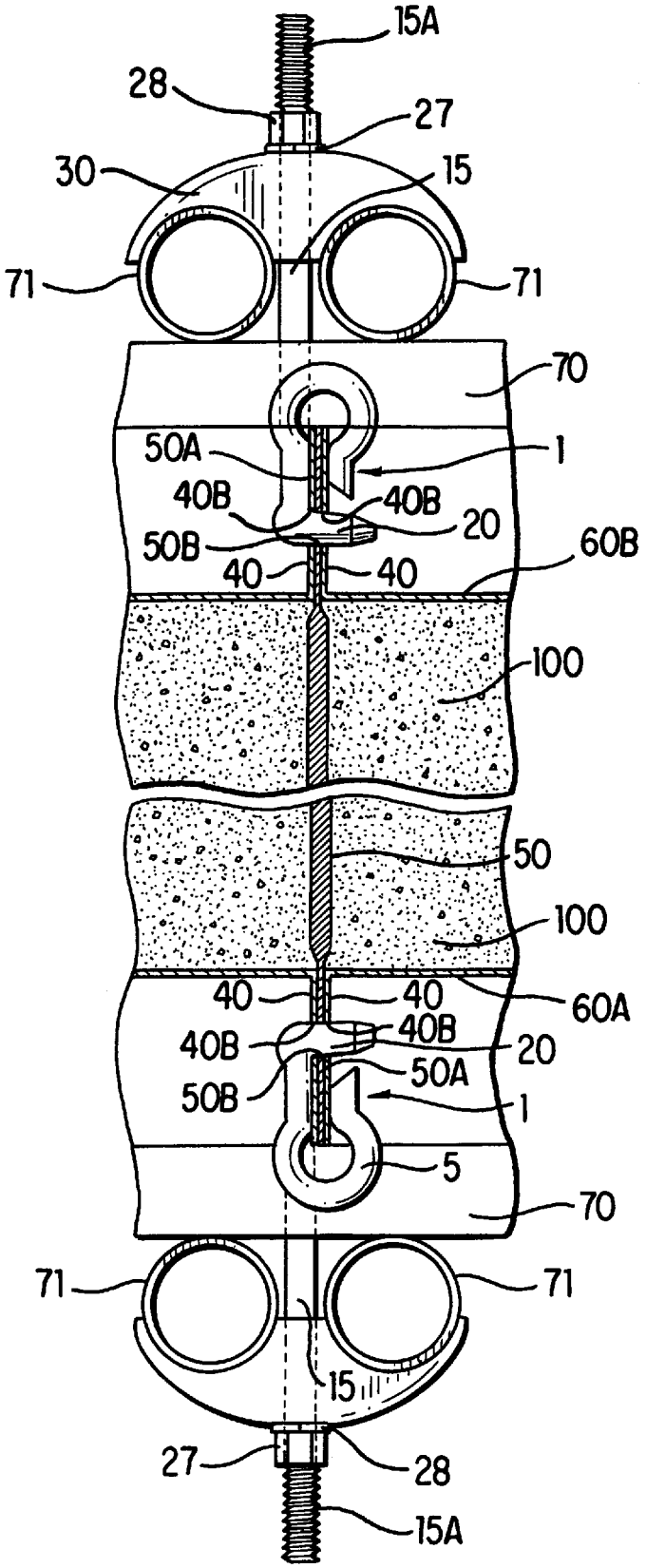
FIG. 2 is a side sectional view of major portions illustrating the use of the embodiment of the present invention.

Referring to FIG. 2, reference numerals 60A and 60B denote a back surface plate and a front surface plate of concrete walls. First, an end 50A of the separator 50 is sandwiched between the frames 40 and 40 of the pair of surface plates 60A and 60B, the holes 40B, 50B and 40B are brought into agreement with each other (hereinafter referred to as superposed holes), and the horizontally protruding portion 20 of the fastening fitting of the invention is inserted in the superposed holes. Usually, this is done by hitting the horizontally protruding portion 20 with a hammer in the direction of arrow X (axial direction of the horizontally protruding portion) in FIG. 1.

Figure 3:
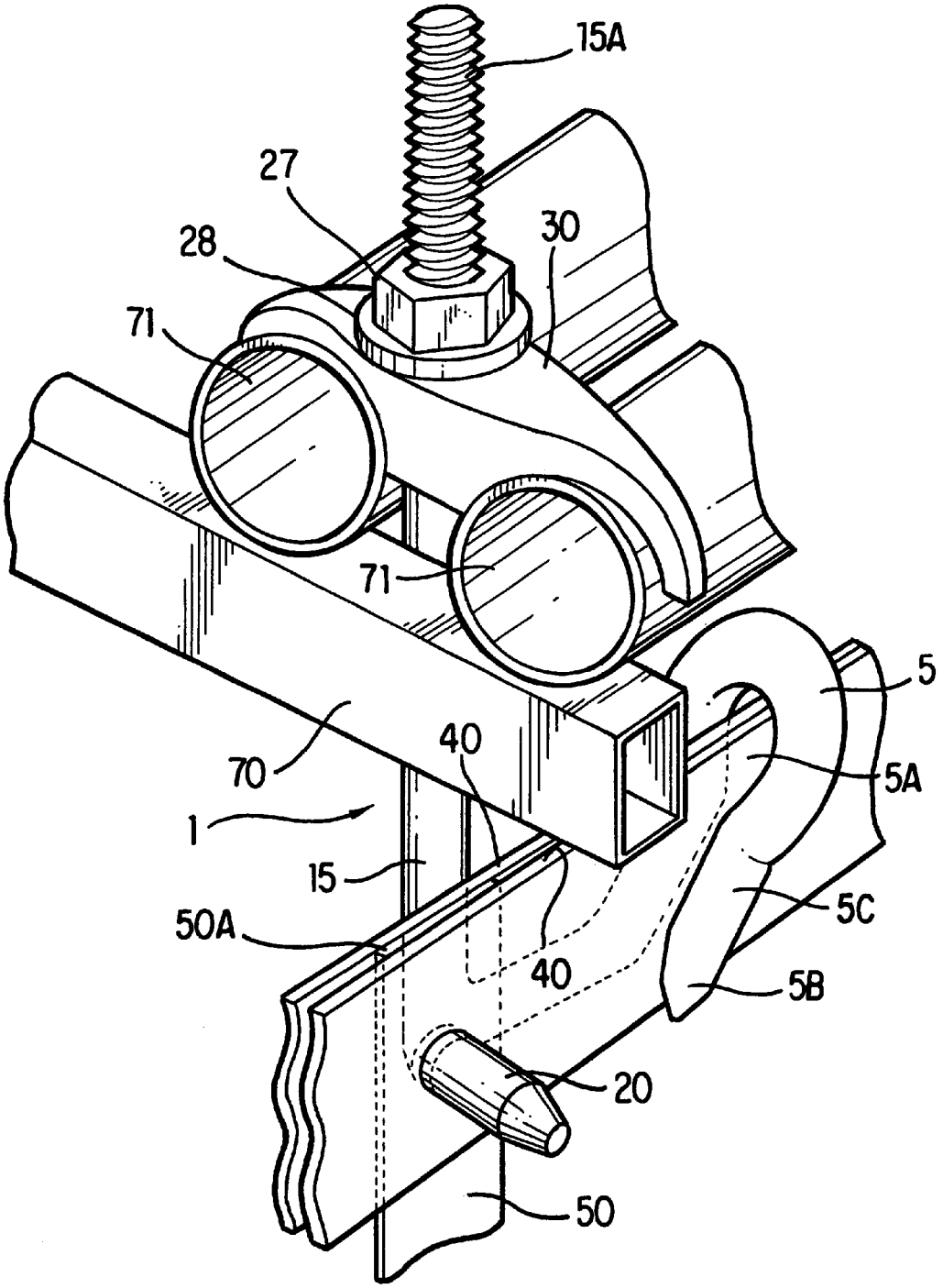
FIG. 3 is a perspective view of major portions illustrating the use of the embodiment.

The horizontally protruding portion 20 is driven into the superposed holes up to its root portion. Then, as shown in FIG. 1, the U-shaped fastening portion with a narrow mouth is hit with a hammer in the direction of an arrow Y nearly perpendicular to the U-shaped plane 5A. That is, the reinforcing member-tightening portion 15 is turned in the direction of an arrow Z with the horizontally protruding portion 20 as an axis, and becomes nearly perpendicular to the horizontal direction or to a portion which is expected to become a concrete wall surface. As shown in FIG. 3, therefore, a reinforcing member 70 (square pipe in this case) and reinforcing members 71 (round pipes in this case) which are crossing relative to each other, are fastened together in a state of being laminated one upon the other and being pressurized. Though FIG. 3 shows the reinforcing member (square pipe) 70 in a number of only one, there may be used two reinforcing members (square pipes) 70 in parallel, as a matter of course.

At the same time, furthermore, the separator 50 extends through the concrete 100 (which has not yet been poured) to be continuous to the junction portion of the opposing front surface plates 60B (the front surface plates are joined in the same manner as the above-mentioned back surface plates). Accordingly, the concrete-molding frames are secured together in an I-shape, and the crossing reinforcing members are firmly tightened and secured to the outer side of the back surface and to the outer side of the front surface of the concrete wall. Upon repeating this work, there can be easily constituted strongly assembled molding frames having large wall areas. The reinforcing members may not be crossed but may be arranged in one way depending upon the thickness of the wall and the area of the wall. Or, the reinforcing members may not be used in pairs but may be used each in a number of one (see FIG. 5).

After the concrete has been solidified, the concrete-molding frames are easily disassembled by removing nuts 27, and are transported and are used again on a next site. However, the separators remain in the concrete wall.

Figure 4:
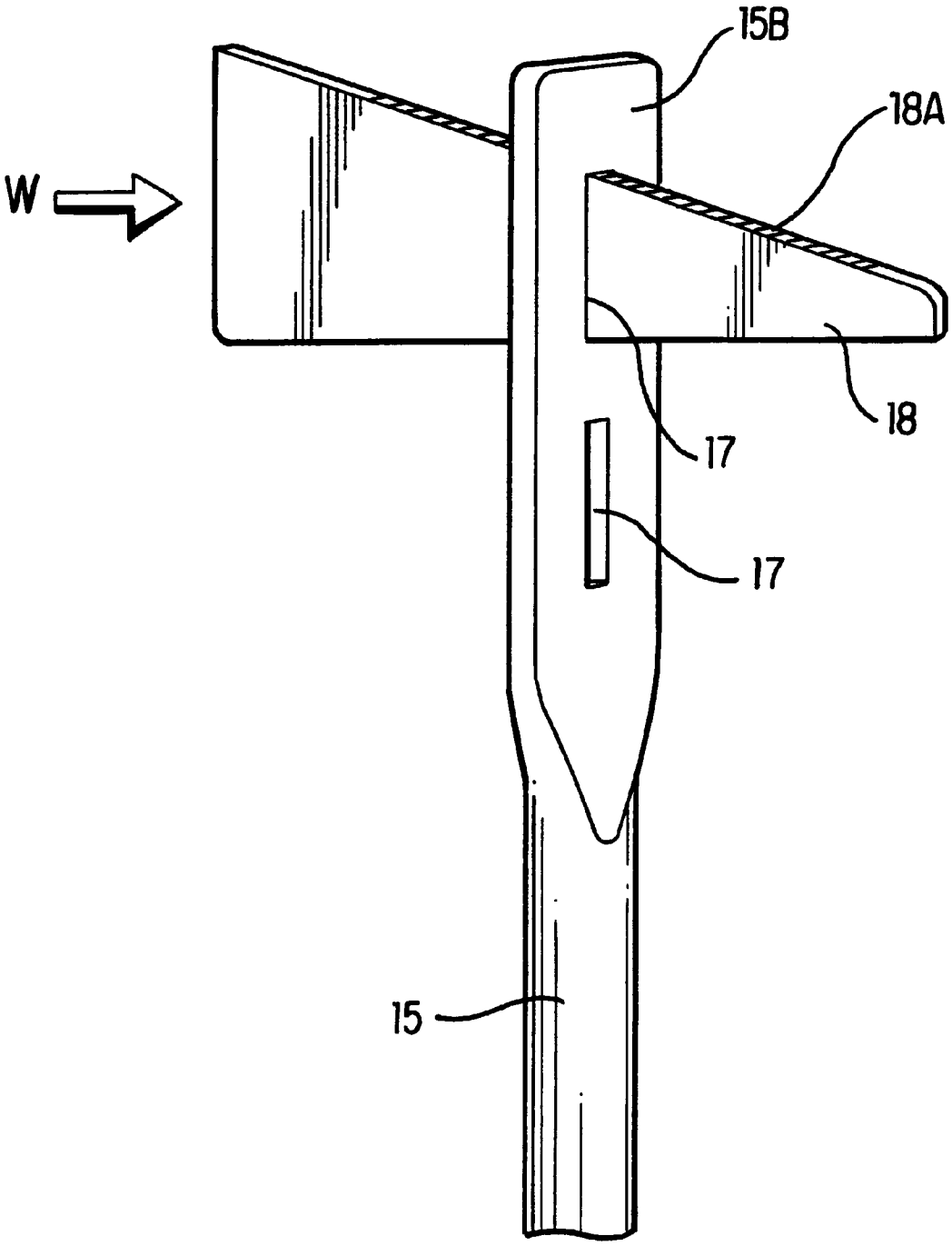
FIG. 4 is a perspective view of a reinforcing member-tightening portion according to another embodiment.
Figure 5:
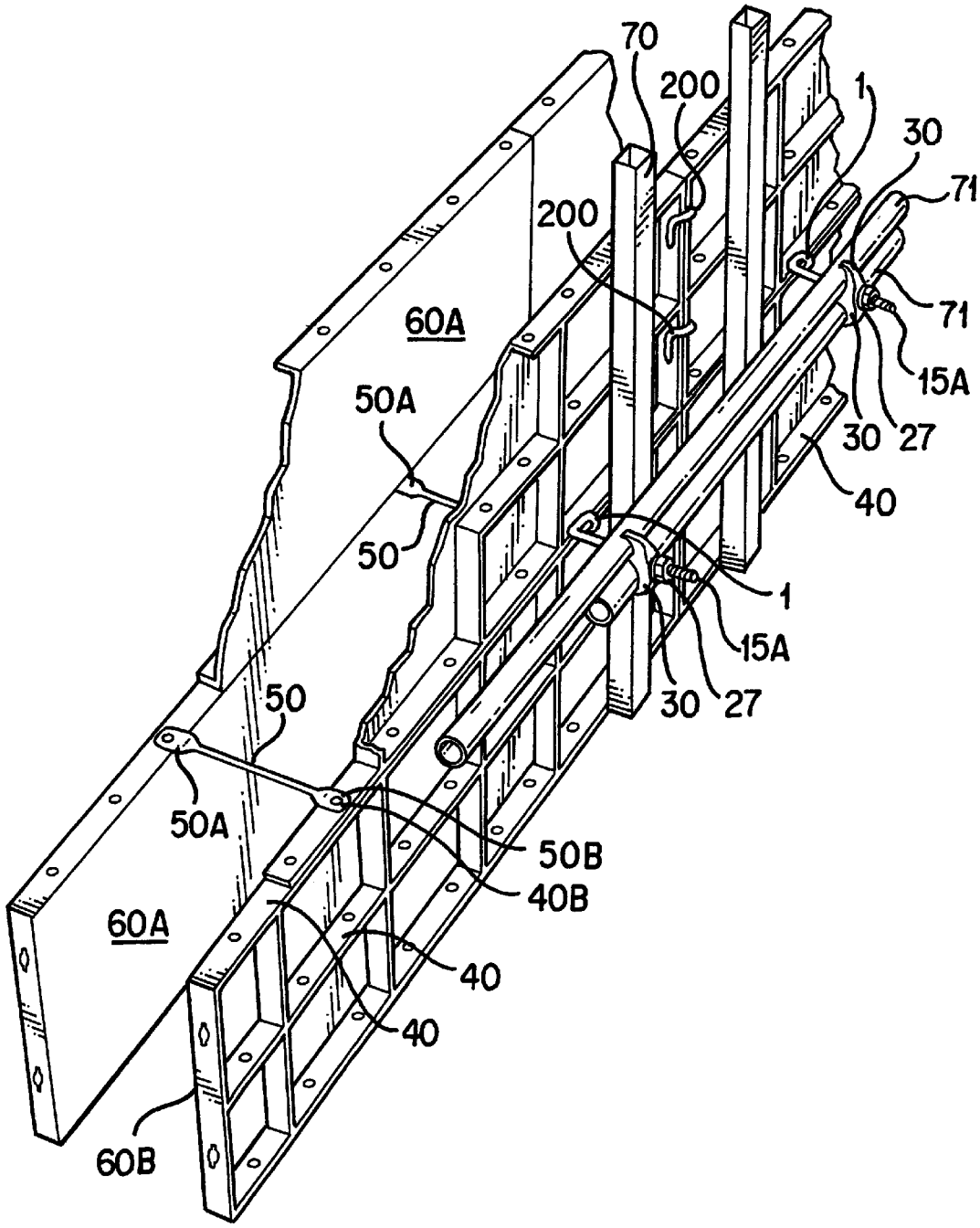
FIG. 5 is a perspective view of a large segment illustrating the use of the embodiment.
Figure 6:
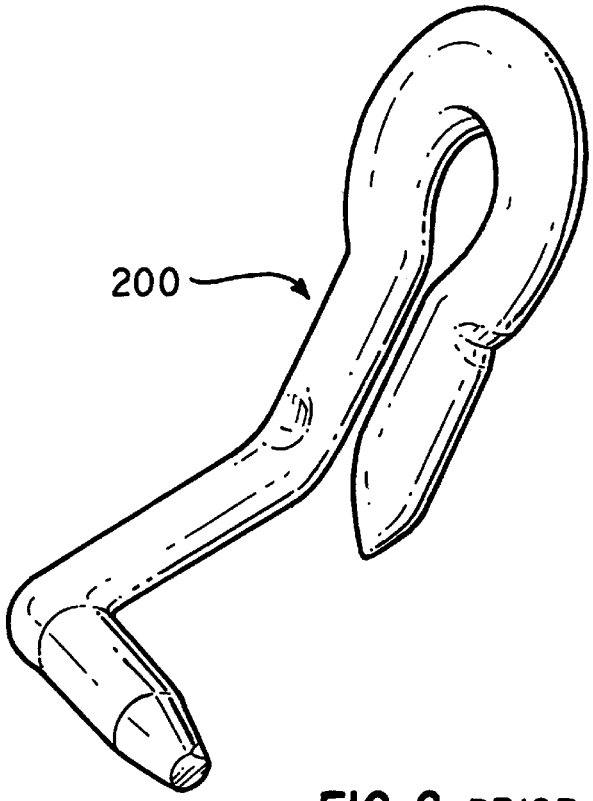
FIG. 6 PRIOR ART
FIG. 6 is a perspective view of a prior art (U-clip)
Figure 7:
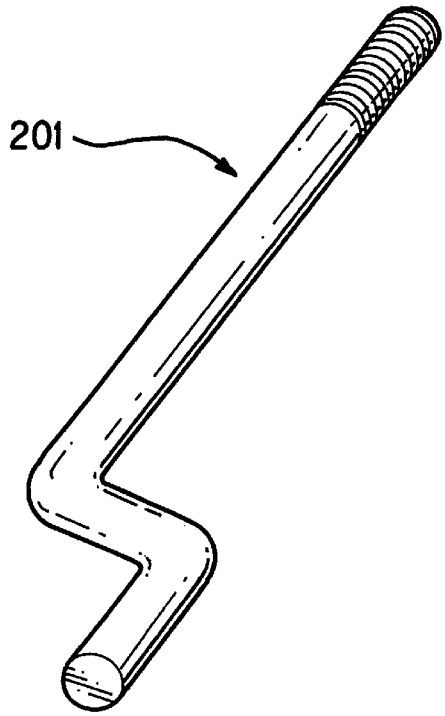
FIG. 7 PRIOR ART
FIG. 7 is a perspective view of a fitting (metal tie) of the twisted type for tightening the reinforcing members according to a prior art.
Figure 8:
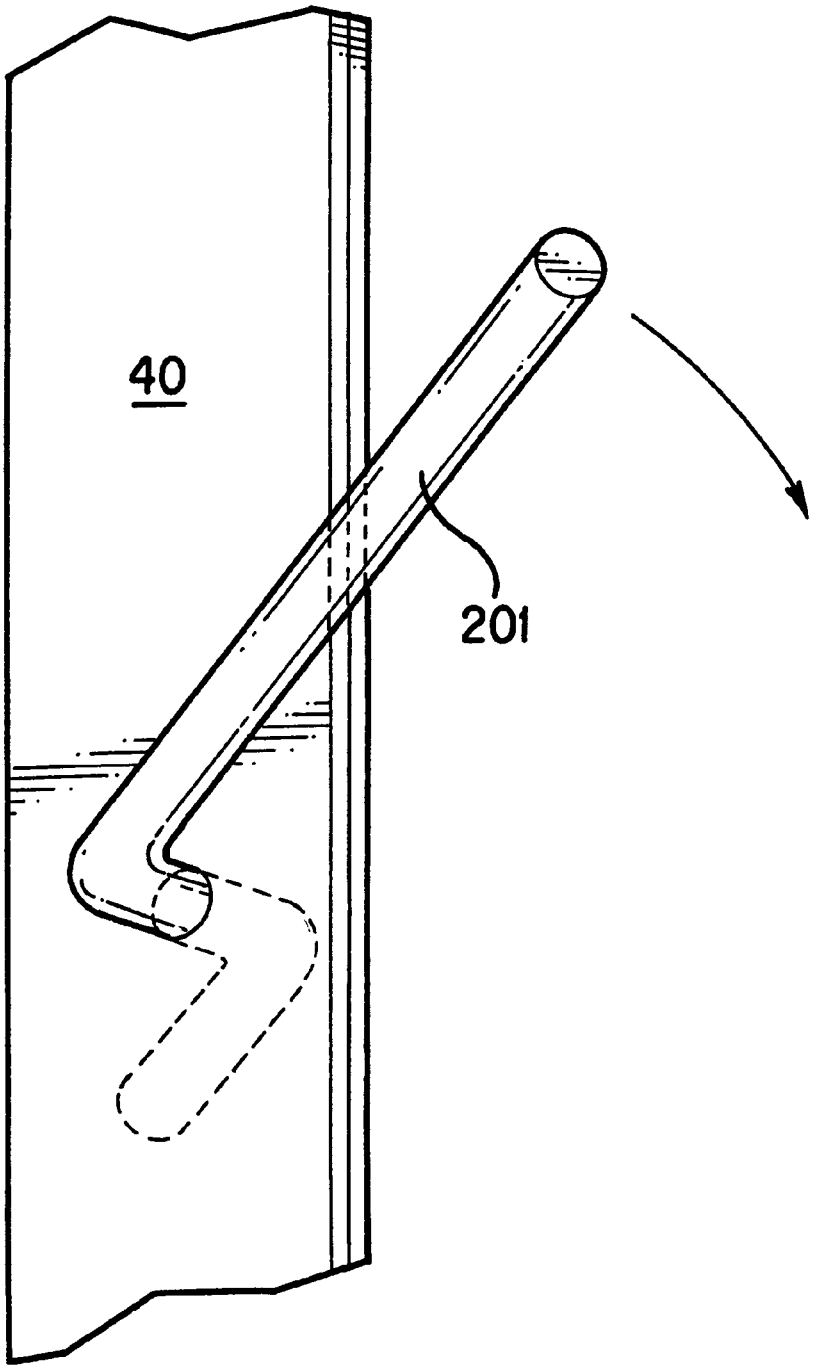
FIG. 8 PRIOR ART
FIG. 8 is a perspective view of the fitting of the twisted type for tightening the reinforcing members (prior art) inserted in the through holes of the frames.

FIG. 4 illustrates the reinforcing member-tightening portion 15 according to another embodiment. A wedge 18 is driven into an elongated hole 17 (which is usually formed in a number of two or more for adjusting the tightening stroke) formed in the end 15B of the reinforcing member-tightening portion by being hit with a hammer from the direction W, so as to easily accomplish the tightening.

Gear-like knurling may be formed on the upper tilted surface of the wedge 18. This makes the fastening more strong, and the wedge 18 after tightened is not easily removed. To disassemble, the wedge 18 is hit with the manner from the direction opposite to the direction W. The reinforcing member-tightening portion using such a wedge is very suited for construction sites where the working environment is not favorable.

By putting the present invention into practice, the above-mentioned objects are all accomplished, solving the defects and problems inherent in the conventional reinforcing member-tightening fittings of the twisted type mentioned earlier. That is, the present invention provides a fastening fitting with a reinforcing member-tightening portion formed as a unitary structure, that contributes to improving working efficiency on a dangerous and narrow working site, yet offering increased strength for the combined molding frames.

What is claimed is:

1. A fastening fitting, comprising:

a U-shaped fastening portion with a straight portion and a narrow mouth for holding a member therein, a linearly extending portion extending from the straight portion to be bent with respect to a plane including the U-shaped fastening portion with an angle between 80 and 130 degrees and having an end, a reinforcing member-tightening portion extending upwardly from the end of the linearly extending portion with an angle between 85 and 110 degrees with respect to the linearly extending portion, and a horizontally protruding portion protruding outwardly from the end of the linearly extending portion substantially parallel to said plane including the U-shaped fastening portion so that the linearly extending portion, the reinforcing member-tightening portion and the horizontally protruding portion intersect at one point.

2. A fastening fitting according to claim 1, wherein an end of said reinforcing member-tightening portion is in a form of a threaded bolt.

3. A fastening fitting according to claim 1, wherein an end of said reinforcing member-tightening portion has a plurality of elongated holes for inserting a wedge.

4. A fastening fitting according to claim 1, wherein a plane including the linearly extending portion and the reinforcing member-tightening portion intersects with said plane including the U-shaped fastening portion at about 90 degrees.

5. A fastening fitting according to claim 1, which is used in combination with a separator having ends on two sides thereof, and molding frames crossing the separator to engage therewith, each of the ends of the separator being held between the molding frames, wherein the horizontally protruding portion is located in holes formed in the molding frames and the end of the separator so that when said U-shaped fastening portion is rotated around the horizontally protruding portion, the U-shaped fastening portion fastens the molding frames.

6. A fastening fitting according to claim 5, wherein said separator is of a form of a straight rod or, a flat plate.

* * * * *